US005642743A

United States Patent [19]

Ranes

[11] Patent Number: 5,642,743

[45] Date of Patent: Jul. 1, 1997

[54] PRESSURIZED CLOSED FLOW CLEANING SYSTEM

[75] Inventor: Randy L. Ranes, League City, Tex.

[73] Assignee: United Laboratories International LLC, St. Charles, Ill.

[21] Appl. No.: 651,639

[22] Filed: May 22, 1996

Related U.S. Application Data

[62] Division of Ser. No. 311,064, Sep. 23, 1994, Pat. No. 5,540,784.

[51] Int. Cl.[6] ..... B08B 3/10

[52] U.S. Cl. ..... 134/108; 134/110; 134/111; 134/169 R; 134/200

[58] Field of Search ..... 134/166 R, 105, 134/169 R, 111, 110, 102.2, 200, 108, 109

[56] References Cited

U.S. PATENT DOCUMENTS

| | | | |
|---|---|---|---|
| 2,385,564 | 9/1945 | Booth et al. | 134/109 |
| 4,101,340 | 7/1978 | Rand | 134/109 |
| 4,756,769 | 7/1988 | Booij | 134/169 R |
| 4,770,197 | 9/1988 | Prisco, Jr. et al. | 134/109 |
| 5,282,889 | 2/1994 | Franklin | 134/169 R |
| 5,370,143 | 12/1994 | Takahashi | 134/200 |
| 5,447,171 | 9/1995 | Shibano | 134/200 |
| 5,469,876 | 11/1995 | Gray et al. | 134/200 |

FOREIGN PATENT DOCUMENTS

| | | | |
|---|---|---|---|
| 1096440 | 12/1967 | United Kingdom | 134/169 R |

*Primary Examiner*—Frankie L. Stinson

*Attorney, Agent, or Firm*—Andrus, Sceales, Starke and Sawall

[57] ABSTRACT

A pressurized closed flow cleaning system for cleaning the interior surface of industrial processing equipment. The system includes a pressure vessel containing an aqueous cleaning solution including the combination of enzymes and a surfactant. A supply conduit connects the pressure vessel with equipment to be cleaned and serves to supply the cleaning solution to the equipment, while a return conduit connects the equipment to the pressure vessel and acts to return the cleaning solution to the pressure vessel, thus providing a closed flow system. The solution is circulated through the closed flow system by a pump located in the supply conduit and the aqueous solution is heated to a temperature, preferably in the range of about 220° F. to 260° F., by a heat exchanger which is located downstream of the pump. Flow of the heated cleaning solution through the equipment to be cleaned will remove oil and solid contaminants. The system also includes a reverse flow manifold which interconnects the supply conduit and the return conduit and acts to selectively reverse the flow of cleaning solution through the equipment. The solution returned to the pressure vessel is maintained in a relatively quiescent state to permit the oil to settle out as an upper layer in the pressure vessel and an oil drain conduit is connected to the vessel for selectively draining oil from the vessel. The pressure vessel also includes a provision for removing benzene and other hydrocarbon gases from the circulating cleaning solution.

16 Claims, 1 Drawing Sheet

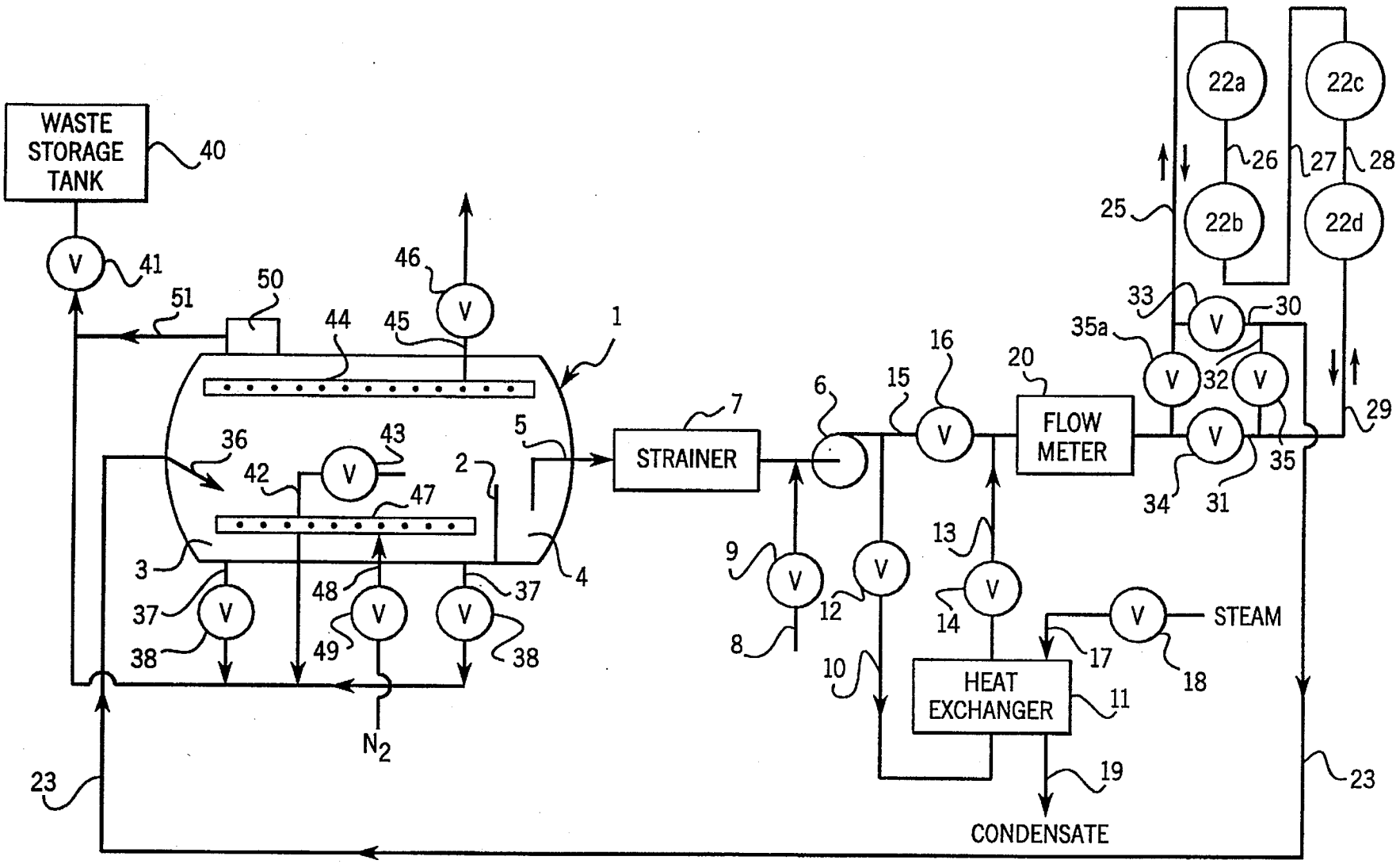
22a
22b
22c
22d
FLOW METER
STEAM
HEAT EXCHANGER
CONDENSATE
STRAINER
WASTE STORAGE TANK
$N_2$

PRESSURIZED CLOSED FLOW CLEANING SYSTEM

This is a division of application Ser. No. 08/311,064, filed Sep. 23, 1994 now U.S. Pat. No. 05,540,784.

BACKGROUND OF THE INVENTION

Chemical processing and oil refinery equipment become contaminated during use with oil and solid deposits, such as coke or iron sulfide. As the processing equipment normally consists of a closed vessel, the typical procedure for cleaning the vessel is to circulate a cleaning solution through the vessel in an attempt to emulsify the oily materials and dissolve the hydrocarbon binders to dislodge the solid particles. The flow of the cleaning solution will then act to flush the residue from the vessel.

It has been found that a cleaning solution which includes the combination of enzymes and a surfactant is extremely effective in removing oil and solid deposits, such as coke or iron sulfide, from industrial processing equipment, as well as from industrial machinery. Not only is this combination of ingredients effective in removing oil and dissolving the binder that binds the coke or iron sulfide particles, but it also has the advantage that when the residual cleaning solution is maintained in a quiescent state, the oil will separate from the water phase, so that the oil can be readily removed from the solution.

It has also been found that the effectiveness of the cleaning solution containing enzymes and a surfactant is increased as the cleaning solution is heated to an elevated temperature. However, when the temperature approaches the boiling point, i.e. 212° F. the solution will boil and due to the presence of the surfactant, tremendous quantities of foam are generated in the cleaning system. The large quantities of foam can cause cavitation of the circulating pump, with the result that the cleaning solution cannot be effectively pumped through the equipment to be cleaned.

SUMMARY OF THE INVENTION

The invention is directed to a pressurized closed flow cleaning system for cleaning vessels and other equipment which utilizes an aqueous solution of enzymes and a surfactant. In accordance with the invention, the pressurized cleaning system includes a pressure vessel that is partially filled with an aqueous cleaning solution containing the combination of enzymes and a surfactant. As the cleaning solution occupies only a portion of the pressure vessel, a headspace is created above the level of the solution in the pressure vessel.

A supply conduit connects the pressure vessel with the equipment to be cleaned which may constitutes one or more closed vessels or pieces of equipment, and the aqueous solution is pumped trough the supply conduit to the equipment by a circulating pump. A return conduit connects the equipment to the pressure vessel for the return of the solution to the pressure vessel.

Located in the supply conduit is a heat exchanger, which is employed to heat the cleaning solution being supplied to the equipment to be cleaned to a temperature generally in the range of about 220° F. to 260° F. The heated cleaning solution, flowing through the equipment to be cleaned at a rate generally in the range of 1000 to 3000 gallons per minute will act to effectively emulsify oils and dissolve the binders in the coke or ferrous deposits on the internal walls of the equipment, thus dislodging the coke or ferrous particles. The dislodged particles will then be carried away by the circulating solution and returned to the pressure vessel. As the process of the invention utilizes high flow rates, the dislodged solid material will be readily flushed from the equipment to be cleaned and conveyed to the pressure vessel.

The pressure vessel includes a weir which divides the vessel into a first inlet section and a second outlet section. The return conduit is connected to the inlet section and the solid particles in the solution being returned to the pressure vessel will tend to settle out in the inlet chamber, while the cleaning solution will overflow the weir into the outlet section and thus be recycled through the supply conduit to the equipment to be cleaned.

The invention also preferably includes a reverse flow manifold which interconnects the supply conduit and the return conduit. The reverse flow manifold includes valving which enables the flow through the equipment to be cleaned to be selectively reversed. The reversal of flow is particularly important when a series of vessels or equipment are to be cleaned which are connected in series.

The invention also includes a provision for periodic blow-down of the solid material which has collected in the pressure vessel. In this regard, a series of blow-down lines are connected to the lower end of the pressure vessel and by momentarily opening the lines, the solid material can be discharged from the pressure vessel to a waste storage tank or other disposal site.

As a further feature of the invention, a provision is made to periodically remove accumulated oil from the cleaning solution in the pressure vessel. As the cleaning solution in the pressure vessel is maintained in a relatively quiescent state, the oil in the solution will collect as an oil phase on the top of the water phase. An oil drain conduit is connected to the pressure vessel at a level communicating with the oil phase, so that oil can be periodically withdrawn from the pressure vessel during the cleaning operation and discharged to the waste storage tank.

When cleaning contaminants from refinery vessels, such as fractionators or heat exchangers, benzene is often entrained in the cleaning solution, and the invention includes a provision to strip the benzene from the cleaning solution in the pressure vessel and discharge the released benzene vapor to a combustion site As the flow system of the invention is pressurized, operating at a pressure generally in the range of 30 to 60 psig, the cleaning solution can be heated to a temperature well above the boiling point of water without generation of foam. Utilizing the cleaning solution at this elevated temperature increases the effectiveness of the solution in emulsifying oil and removing the solid deposits from the equipment wall.

The invention also enables the solid residue, oil and hydrocarbon gases, such as benzene, to be removed from the pressure vessel while the cleaning operation is in progress and there is no release of any contaminants to the atmosphere through use of the process of the invention.

Other objects and advantages will appear in the course of the following description.

DESCRIPTION OF THE DRAWINGS

The drawing illustrates the best mode presently contemplated of carrying out the invention.

In the drawing:

The drawing is a diagrammatic flow chart illustrating the process of the invention.

DESCRIPTION OF THE ILLUSTRATED EMBODIMENT

The drawing is a diagrammatic representation of the process of the invention utilized to clean a series of closed vessels or processing equipment, such as used in chemical processing or oil refineries.

As shown in the drawing, a closed pressure vessel 1 contains an aqueous cleaning solution composed of a combination of enzymes and surfactant. The cleaning solution can be of the type described in U.S. patent application Ser. No. 08/128,061, filed Sep. 29, 1993, in which the aqueous solution contains about 1 to 200 ppm of enzymes selected from the group consisting of proteases, amylases, lipases, cellulases, and mixtures thereof, along with about 30 to 2100 ppm of a surfactant having the following formula:

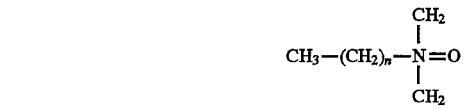

where n is 6 to 20. More specifically, the surfactant may be lauryl dimethyl amine oxide, stearyl dimethyl amine oxide, myristyl dimethyl amine oxide, and mixtures thereof.

Located in vessel 1 is a weir 2 which extends upwardly from the bottom surface of the pressure vessel and divides the vessel into an inlet section 3 and an outlet section 4. An outlet line 5 is connected to one end of the vessel and communicates with outlet section 4 and the cleaning solution contained within vessel 1 is drawn through the outlet line 5 by a pump 6. A suitable strainer 7 can be connected in line 5 to remove solid contaminants from the cleaning solution. While the drawing illustrates a single strainer being utilized, it is contemplated that a pair of strainers may be employed in parallel, with one strainer being utilized while the second strainer is down for maintenance or cleaning.

A concentrated mixture of enzymes and surfactant can be introduced into the closed system through line 8, which is connected to line 5, and flow through line 8 is controlled by a suitable valve 9. On start-up, vessel 1 may contain only water and the concentrated cleaning solution is then fed into the water being circulated through line 5. When the concentration of enzymes and surfactant reaches the desired level, the flow through line 8 can then be terminated.

The cleaning solution is preferably heated to a temperature in the range of about 220° F. to 260° F. and, to achieve this temperature, the cleaning solution is passed through line 10 to heat exchanger 11. Flow through line 10 can be controlled by valve 12. The heated solution after passing through the heat exchanger is conducted through line 13 to line 15 and flow through line 13 can be controlled by valve 14. In addition, valve 16 is mounted in line 15 between the junctions of lines 10 and 13. With valve 16 closed, and valves 12 and 14 open, the cleaning solution will flow through the heat exchanger 11. Conversely, with valves 12 and 14 closed, and valve 16 open, the cleaning solution will flow directly through line 15 to the equipment to be cleaned.

As illustrated in the drawing, the heating medium used to heat the cleaning solution in heat exchanger 11 is steam, which is introduced into the heat exchanger through line 17, and valve 18 is mounted in line 17 to control the flow therein. Steam condensate is discharged from the heat exchanger through line 19.

Mounted in line 15 is a flow meter 20, which indicates the rate of flow of the solution flowing to the equipment to be cleaned.

Line 5 along with line 15 constitute a supply conduit which is connected to one or a series of vessels or other pieces of equipment to be cleaned. As shown in the drawing, four closed vessels **22*a*–22*d* are connected in series and the internal surfaces of the vessels are adapted to be cleaned by flowing the cleaning solution through the vessels. While the drawings illustrate four vessels 22*a*–22*d* being cleaned through the process of the invention, it is contemplated that one or more vessels or other pieces of equipment may be connected in the closed flow system for cleaning. Line 25 connects line 15 with the first vessel to be cleaned 22*a*, while line 26 connects vessel 22*a* and 22*b*, line 27 connects vessel 22*b* to vessel 22*c*, and line 28 connects vessel 22*c* to vessel 22*d*. In addition, line 29 is connected to vessel 22*d***.

The heated cleaning solution is circulated through vessels **22*a*–22*d* at a rate generally in the range of 1000 to 3000 gallons per minute. The cleaning solution serves to remove oil and lipophilic materials from the internal walls of the vessels and also attacks and removes the hydrocarbon binders that bonds solid particles of coke or iron sulfide together, thus dislodging the particles from the vessel walls. The dislodged particles, as well as the oil contaminants, will be flushed from the vessels 22*a*–22*d* by the flow of the cleaning solution and returned to pressure vessel 1 through return line 23**.

As a feature of the invention, a reverse flow manifold is incorporated to reverse the flow through lines 25 and 29 to provide more effective cleaning of the vessels. The reverse flow manifold is particularly useful when a series of vessels or other pieces of equipment are connected in series for cleaning as shown in the drawing.

The reverse flow is accomplished by connecting lines 30 and 31 to line 25, with line 30 being connected to return line 23 and line 31 being connected to line 29. In addition, bypass line 32 connects lines 30 and 29. Valves 33, 34, 35 and **35*a* are mounted in lines 30, 29, 32 and 25, respectively. With this arrangement, closing valves 33 and 34 and opening valves 35 and 35*a* will cause flow through line 25, through vessels 22*a*–22*d*, and then through line 29 and line 32 to return line 23. On the other hand, closing valves 35 and 35*a* and opening valves 33 and 34, will result in flow in the opposite direction through the vessels 22*a*–22*d***.

The cleaning solution being returned through line 23 to pressure vessel 1 is introduced into the inlet section 3 through a downwardly inclined inlet 36. The downwardly inclined attitude of inlet 36 will aid in enabling the solid particles in the circulating solution to settle in the lower portion of vessel 1.

The invention also includes a provision for periodically discharging or purging the solid materials that have collected in the bottom portion of inlet section 3 of vessel 1. In this regard, a series of blow-down lines 37 are connected to the bottom of vessel 1. While the drawings show two lines 37, it is contemplated that any number of such lines can be utilized, with each line including a flow control valve 38. Lines 37 are connected to line 39 which, in turn, is connected to waste storage tank 40. The closed flow system is normally operating at a pressure in the range of about 30 to 60 psig, and by momentarily opening valves 38 in lines 37, a blow-down will occur which will cause solid material collected in the bottom of pressure vessel 1 to be discharged through lines 37 and then to the waste tank 40.

It is contemplated that suitable strainers can be mounted in lines 37, if desired, to strain out the solid particles from the mixture of liquid and solid being discharged during the blow-out, so that the solid materials will be separated and not be discharged to the waste storage tank 40.

While the cleaning solution includes a surfactant which would normally tend to maintain oil in an emulsified state in the aqueous cleaning solution, the combination of enzymes and surfactants has the unusual characteristic of enabling the oil to settle out as an oil phase when the cleaning solution is maintained in a quiescent state. Thus, the oil which has been removed from the vessels 22a–22d and returned to the pressure vessel 1 with the cleaning solution will settle out in pressure vessel 1 as an upper oil phase. This oil phase can be periodically removed through an oil drain line 42, which is connected to the pressure vessel at a level in alignment with the collected oil phase. This level is slightly above the upper edge of weir 2. Line 42 can be connected to line 39 and flow through line 42 can be controlled by valve 43. By opening valve 43, the oil can be drained from the pressure vessel 1 while the system is operating and the oil can then be discharged to the waste storage tank.

While the drawing shows only a single oil drain line 42 connected to pressure vessel 1, it is contemplated that two or more drain lines can be used, each connected at a different vertical level to the pressure vessel. In addition, suitable sight glasses, not shown, may be connected to vessel 1 to provide a visual indication of the level of the separated oil layer. After determining the level of the oil layer through use of the sight glass, the proper oil drain line in the series can be opened to discharge the oil.

When cleaning oil refinery equipment, or other equipment used for processing hydrocarbons, benzene may be entrained in the cleaning solution. As the cleaning solution is normally operating at a temperature above the boiling point of benzene, the benzene will vaporize and the vapor will be released from the cleaning solution in pressure vessel 1.

As shown in the drawings, a perforated tube 44 is mounted in the upper portion of pressure vessel 1 in the headspace above the liquid level. Line 45 is connected to the interior of tube 44 and valve 46 is mounted in line 45 to control the flow therethrough. Benzene vapor or other hydrocarbon gases being released from the circulating cleaning solution in pressure vessel 1 will be discharged into tube 44 when valve 46 is open and discharged from the vessel through line 45 to a flare or other combustion disposal equipment. In order to aid in stripping the gases from the cleaning solution, nitrogen gas can be introduced into the lower portion of pressure vessel 1. In this regard, a perforated tube 47 is mounted in the inlet section 3 adjacent the bottom of the tank and nitrogen is introduced into the tube through line 48. Flow through line 48 can be controlled by valve 49. The nitrogen will bubble upwardly through the cleaning solution to strip the benzene and the gases will then be discharged through tube 44 and line 45.

A conventional pressure regulator valve 50 can be mounted on vessel 1 and if the internal pressure exceeds a pre-selected value, valve 50 will open to discharge fluid from vessel 1 through line 51 to the waste storage tank.

In operation of the closed system, which normally operates at a pressure of 30 to 60 psig, the cleaning solution will be continuously circulated from the pressure vessel 1 by pump 6, through the heat exchanger 11, and then through the vessel 22a–22d to be cleaned, and then returned through line 23 to the pressure vessel. Periodically the flow through the vessels 22a–22d can be reversed to provide more effective cleaning and flushing of the dislodged particles.

As the system is pressurized and is not open to the atmosphere, temperatures above the boiling point of water can be employed without foaming of the cleaning solution. This is important since the cleaning solution contains a major concentration of a surfactant which promotes foaming.

The system of the invention enables oil and solid material to be periodically removed from pressure vessel 1 while the cleaning operation is in process. The process also removes hydrocarbon gases, such as benzene, from the pressure vessel for suitable disposal or combustion, so that there is no release of any components to the atmosphere.

Various modes of carrying out the invention are contemplated as being within the scope of the following claims particularly pointing out and distinctly claiming the subject matter which is regarded as the invention.

I claim:

1. A continuous closed pressurized system for cleaning the internal surfaces of equipment, comprising a closed pressure vessel containing an aqueous cleaning solution including a combination of enzymes and a surfactant, a supply conduit connecting said pressure vessel with equipment to be cleaned for supplying cleaning solution from said pressure vessel to said equipment, a return conduit connecting said equipment with said pressure vessel for returning cleaning solution from said equipment to said pressure vessel, said pressure vessel and said supply conduit and said equipment and said return conduit comprising a closed flow system, heating means in said supply conduit for heating said cleaning solution to a temperature above the boiling point of water, pumping means for continuously pumping said solution through said closed flow system to thereby remove oil and solid contaminants from said equipment with said oil and solid contaminants being returned to said pressure vessel through said return conduit, said oil separating from said aqueous cleaning solution in said pressure vessel as an upper oil layer, reverse flow means connecting said supply conduit with said return conduit for reversing the flow of solution through said equipment, separating means in said pressure vessel for separating solid contaminants from said aqueous cleaning solution, and oil draining means connected to said pressure vessel for selectively draining oil from said oil layer.

2. The system of claim 1, wherein said closed flow system is at a pressure of 30 to 60 psig.

3. The system of claim 1, wherein said reverse flow means includes a manifold connecting said supply conduit and said return conduit, and valve means in said manifold for reversing the flow of solution through said equipment.

4. The system of claim 1, and including means for releasing gaseous contaminants from the cleaning solution and discharging said gaseous contaminants to a disposal site.

5. The system of claim 4, wherein said means for releasing gaseous contaminants comprises a perforated tubular member disposed in the upper portion of said pressure vessel above the level of said cleaning solution, said tubular member disposed to receive said gaseous contaminates, and a discharge conduit connected to said tubular member for conducting said gaseous contaminants to the disposal site.

6. The system of claim 5, and including a valve member disposed in said discharge conduit for controlling the flow of said gaseous contaminants therethrough.

7. The system of claim 4, and including means for introducing a generally inert gas into said pressure vessel at a location beneath the level of said aqueous solution, to thereby aid in the release of said gaseous contaminants from said solution.

8. The system of claim 7, wherein said inert gas is nitrogen and said means for introducing said gas into said pressure vessel comprises a perforated tubular member connected to a source of nitrogen and located in the lower portion of said pressure vessel beneath the liquid level therein.

9. The system of claim 1, wherein said separating means comprises a weir extending upwardly from the bottom of said pressure vessel and dividing said pressure vessel into an inlet section and an outlet section, said return conduit communicating with said inlet section and said supply conduit being connected to said outlet section, said solid contaminants being collected in said inlet section.

10. The system of claim 1, wherein said oil draining means comprises a drain conduit connected to the pressure vessel at a level communicating with said oil layer, and a valve member connected in said drain conduit for controlling the flow of oil therein.

11. A closed pressurized system for cleaning internal surfaces of equipment, comprising a closed piece of equipment having solid and oil contaminants on an interior surface thereof, a closed pressure vessel containing an aqueous cleaning solution including the combination of enzymes and a surfactant, a supply conduit connecting the pressure vessel with said equipment, a return conduit connecting said equipment with said pressure vessel, said pressure vessel, said supply conduit, said equipment and said return conduit comprising a closed flow system free of exposure to the atmosphere, pumping means in said supply conduit for pumping said cleaning solution from the pressure vessel through said equipment and returning the solution through said return conduit to said pressure vessel, heating means in said supply conduit for heating the cleaning solution, said heated cleaning solution acting to remove said oil contaminants from said equipment and to dislodge said solid contaminants from the equipment surface, said removed oil and solid contaminants being returned to said pressure vessel through said return conduit, means for maintaining the cleaning solution in said pressure vessel in a relatively quiescent state to permit the oil contaminants to separate from the cleaning solution as an upper oil phase, oil draining means including a drain conduit connected to the pressure vessel at the level of said oil phase for draining oil from said pressure vessel, and separating means in said closed flow system for separating said solid contaminants from said aqueous solution.

12. The system of claim 11, and including means to remove gaseous contaminants from the upper portion of said pressure vessel.

13. The system of claim 12, wherein said gaseous contaminants comprise benzene vapor and said means to remove said gaseous contaminants includes means for introducing nitrogen into the aqueous solution to strip benzene vapor from said solution, and a gas discharge conduit connected to said pressure vessel for discharging said benzene vapor from the pressure vessel.

14. The system of claim 13, wherein said means for introducing nitrogen into said pressure vessel comprises a perforated tube located adjacent the bottom of said pressure vessel, and a supply line connecting said perforated tube with a source of nitrogen gas.

15. The system of claim 11, wherein said separating means comprises a weir extending upwardly from the lower portion of said pressure vessel and dividing said pressure vessel into a first section and a second section, said return conduit being connected to said first section and said supply conduit being connected to said second section, said solid contaminants being collected in the bottom of said first section.

16. The system of claim 15, wherein said oil drain means is connected to said pressure vessel at a level above the upper edge of said weir.

* * * * *